US007686501B2

(12) United States Patent
Bruce

(10) Patent No.: US 7,686,501 B2
(45) Date of Patent: Mar. 30, 2010

(54) BAR TOOL ASSEMBLY WITH A BEVERAGE SHAKER

(75) Inventor: Travis Bruce, Brooklyn, NY (US)

(73) Assignee: Godinger Silver Art Co., Ltd., New York, NY (US)

( * ) Notice: Subject to any disclaimer, the term of this patent is extended or adjusted under 35 U.S.C. 154(b) by 1135 days.

(21) Appl. No.: 11/289,239

(22) Filed: Nov. 29, 2005

(65) Prior Publication Data

US 2007/0131118 A1 Jun. 14, 2007

(51) Int. Cl.
*A47J 43/27* (2006.01)

(52) U.S. Cl. ..... 366/130; 220/568; D7/300.1; D7/619.2

(58) Field of Classification Search ..... 366/129, 366/130, 349; 220/568; 446/432; D7/300.1, D7/619.2, 305, 301, 412, 376, 604, 599; D21/555

See application file for complete search history.

(56) References Cited

U.S. PATENT DOCUMENTS

D54,453 S * 2/1920 Richardson et al.
1,725,265 A * 8/1929 Glendinning
D91,447 S * 1/1934 Wehrenberg
D125,417 S * 2/1941 Kimmel
3,731,428 A * 5/1973 Glass et al.
D232,133 S * 7/1974 Metzner et al.
4,173,840 A * 11/1979 Fahrendorf et al.
4,334,724 A * 6/1982 Rogers, Sr.
D278,506 S * 4/1985 Kafka
4,575,255 A * 3/1986 Kafka
D284,954 S * 8/1986 Lamb
D291,767 S * 9/1987 Osit
5,389,031 A * 2/1995 Sharpe et al.
D390,415 S * 2/1998 Hippen et al. ..... D7/412
D391,116 S * 2/1998 Hippen et al. ..... D7/412
5,873,763 A * 2/1999 Morgan ..... 446/78
5,979,850 A * 11/1999 Hippen et al. ..... 248/309.2
D462,569 S * 9/2002 Chin ..... D7/376
D511,930 S * 11/2005 Wong ..... D7/376
D577,546 S * 9/2008 Ferraby ..... D7/412
D579,271 S * 10/2008 Ferraby ..... D7/412
D581,725 S * 12/2008 Wong ..... D7/376
2005/0106993 A1* 5/2005 Fosbenner et al. ..... 446/432
2005/0155186 A1* 7/2005 McGuyer et al. ..... 16/430
2007/0131118 A1* 6/2007 Bruce

* cited by examiner

*Primary Examiner*—Charles E Cooley
(74) *Attorney, Agent, or Firm*—Cohen Pontani Lieberman & Pavane LLP

(57) ABSTRACT

A bar tool set assembly for producing mixed beverages. The assembly includes a platform module adapted for housing and transposing a bar tool set. The housing having a form factor and appearance of a replica of a partially disassembled consumer or industrial product, whereas individual bar tools resemble portions of the product. In one embodiment, the bar tool set assembly resembles a fire truck.

13 Claims, 4 Drawing Sheets

BAR TOOL ASSEMBLY WITH A BEVERAGE SHAKER

BACKGROUND OF THE INVENTION

1. Field of the Invention

The present invention generally relates to equipment for beverage preparation and, in particular, to an assembly of bar tools useful for preparing mixed drinks such as cocktails.

2. Description of the Related Art

Commercial drinking establishments serving alcoholic beverages employ various types of decor or motifs, not only to distinguish themselves from one another, but also to enhance the experience of their patrons. Presumably this leads to at least certain patrons frequenting such bars more often and/or lingering for longer periods of time during such visits. As a consequence, patrons will spend more money. The decor can include the color of the walls, type of furniture, design of the "bar" itself, i.e. the table behind which a bartender prepares drinks for customers, as well as the design of the drinking glasses, dishes, and other accoutrements, all of which can enhance the appeal of an establishment. In such commercial establishments, the bar itself is often the focal point of the room.

In residences, bars are also the focal points of the rooms in which they are situated. Residence owners typically look for ways to enhance the entertainment value of their bars, such as from the decor, lighting, and the incorporation of games such as billiards. Such techniques, however, are costly and do not always result in the desired effect of increasing the novelty of the bar. Other techniques include the purchase of stylish drinking glasses, dishes, and certain bar ware items. In general, however, bar ware such as bar tool sets represent loose collections of individual components (e.g., shakers, ice tongs, bottle openers, jiggers and stirrers, etc.) used in mixing and serving drinks and cocktails. Such tools and items are difficult to keep organized, transfer between several serving positions such as locations along a bar countertop and, because they do not add any visual appeal from a novelty perspective, are oftentimes kept in drawers or otherwise out of view of customers and guests. Although certain bar tool sets exist which have tools showing a common design, such sets also do not provide a certain novelty appeal and, hence, are usually stored out of view of guests.

Accordingly, there is a need for a bar tool set having a novelty and entertainment value.

SUMMARY OF THE INVENTION

The present invention generally relates to utensils such as tools for producing mixed drinks such as cocktails. In a first aspect of the present invention, there is provided a bar tool assembly comprising a platform module and a set of bar tools. The platform module is adapted for housing and supporting the bar tool set on a substantially flat surface, such as a bar top, a counter, and the like. The platform module has a form factor and appearance of a replica of a partially disassembled consumer or industrial product, and at least one of the bar tools of that set has a form factor and appearance of at least one removed portion of that product. The platform module having at least one bar tool from the bar tool set disposed on itself attains the form factor and appearance of the replica of the assembled consumer or industrial product.

In a second aspect of the present invention, the consumer product is a toy truck, such as a fire truck. In one embodiment, the bar tool set comprises a shaker, a cork screw, a bottle opener, a jigger, stirrers and ice tongs, each having a form factor and appearance of a component of the fire truck's equipment or machinery.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings.

The teachings of the present invention will become apparent by considering the following detailed description in conjunction with the accompanying drawings, in which.

The appended drawings illustrate exemplary embodiments of the invention and, as such, should not be considered limiting the scope of the invention that may admit to other equally effective embodiments.

DETAILED DESCRIPTION OF THE PRESENTLY PREFERRED EMBODIMENTS

The present invention generally relates to bar equipment for producing and/or serving mixed drinks, e.g. cocktails. Such mixed drinks are made according to recipes which require predetermined quantities (volumes) of mixed and/or stirred compositions of component bottled alcoholic and non-alcoholic beverages, with or without non-liquid additives (e.g., temperature regulating additives such as ice cubes, taste-modulating additives such as spices, fresh or preserved fruits, and the like).

Figure 1:
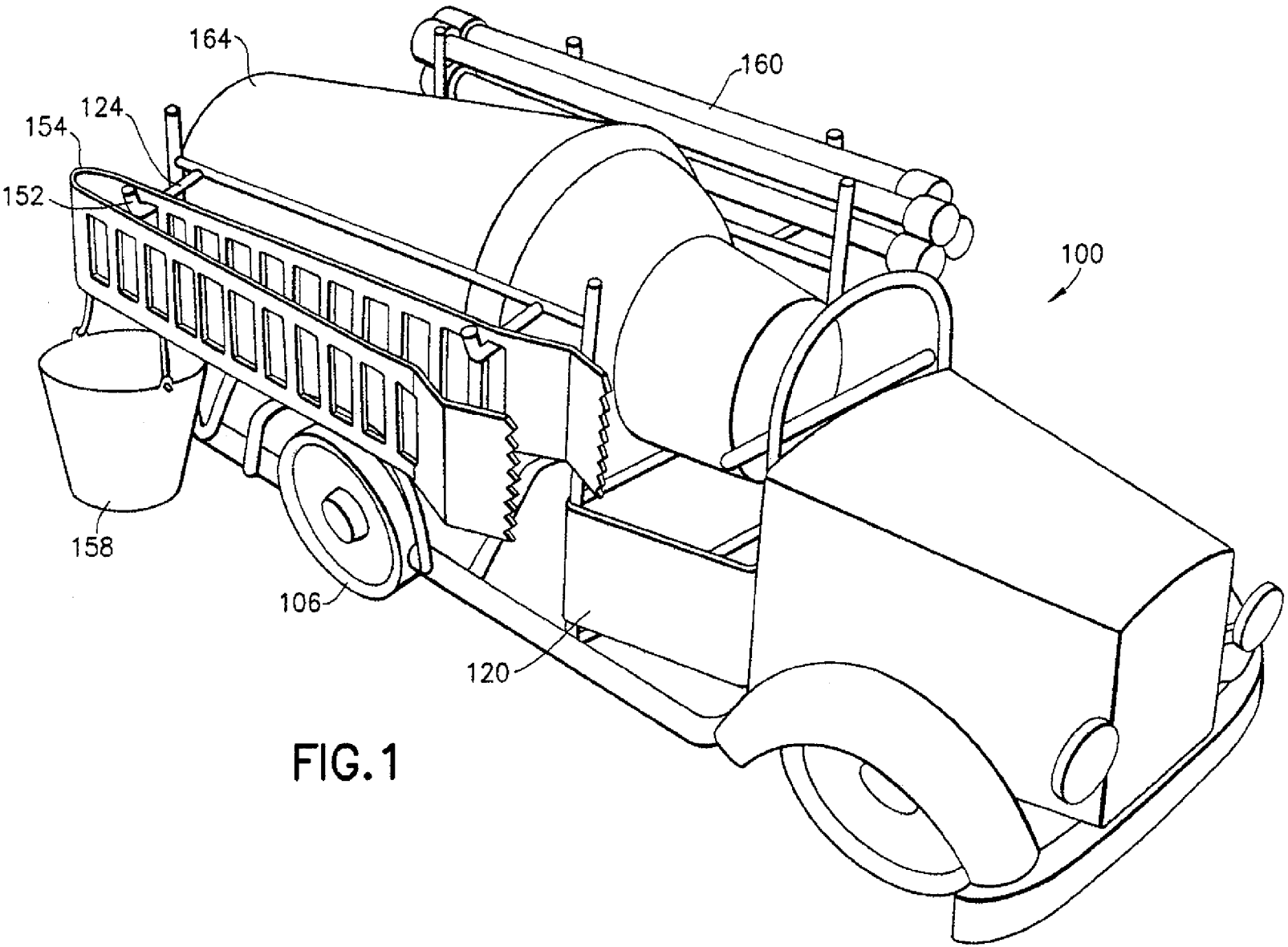
FIG. 1 depicts a right-side perspective view of an exemplary bar tool assembly having a form factor and appearance of a toy fire truck having bar tools mounted thereto in accordance with one embodiment of the present invention.
Figure 2:
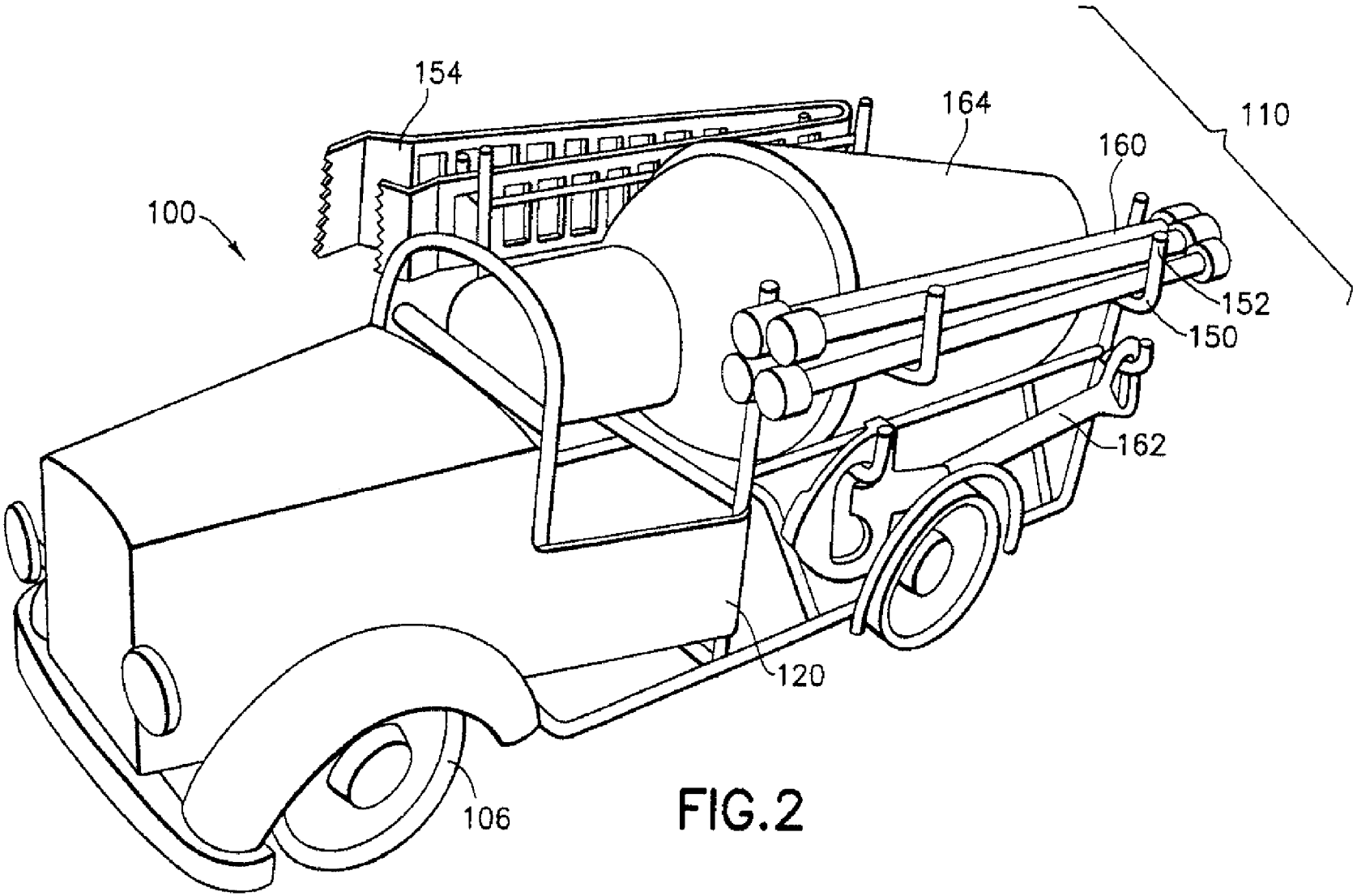
FIG. 2 depicts a left-side perspective view of the assembly of FIG. 1.

FIGS. 1 and 2 depict left-side and right-side views, respectively, of an exemplary bar tool assembly 100 of the kind that may be used to practice portions of the invention. Herein, similar devices are identified using the same numeric references. The bar tool assembly 100 generally comprises a bar tool set 110 and a platform module 120. The platform module 120 is adapted for housing and supporting the bar tool set 110 on a substantially flat surface (not shown) and also may be used to transport the set 110 across the surface.

The bar tool set 110 includes a plurality of bar tools 102 such as ice tongs 154. Each bar tool has a form factor and appearance of a portion or component of a consumer or industrial product. Components of the bar tool set 110 (i.e., individual bar tools) may be detachably mounted on the platform module 120.

When at least one bar tool of the bar tool set 110 is secured on the platform module 120, the bar tool assembly 100 has a form factor and appearance of a consumer or industrial product or a replica (e.g., toy replica) of such a product. Correspondingly, when at least one bar tool is removed from the platform module 120, the bar tool assembly 100 resembles a partially disassembled product or a partially disassembled replica of the product. Hereafter, the terms "product" and "replica of the product" are used interchangeably.

Figure 4:
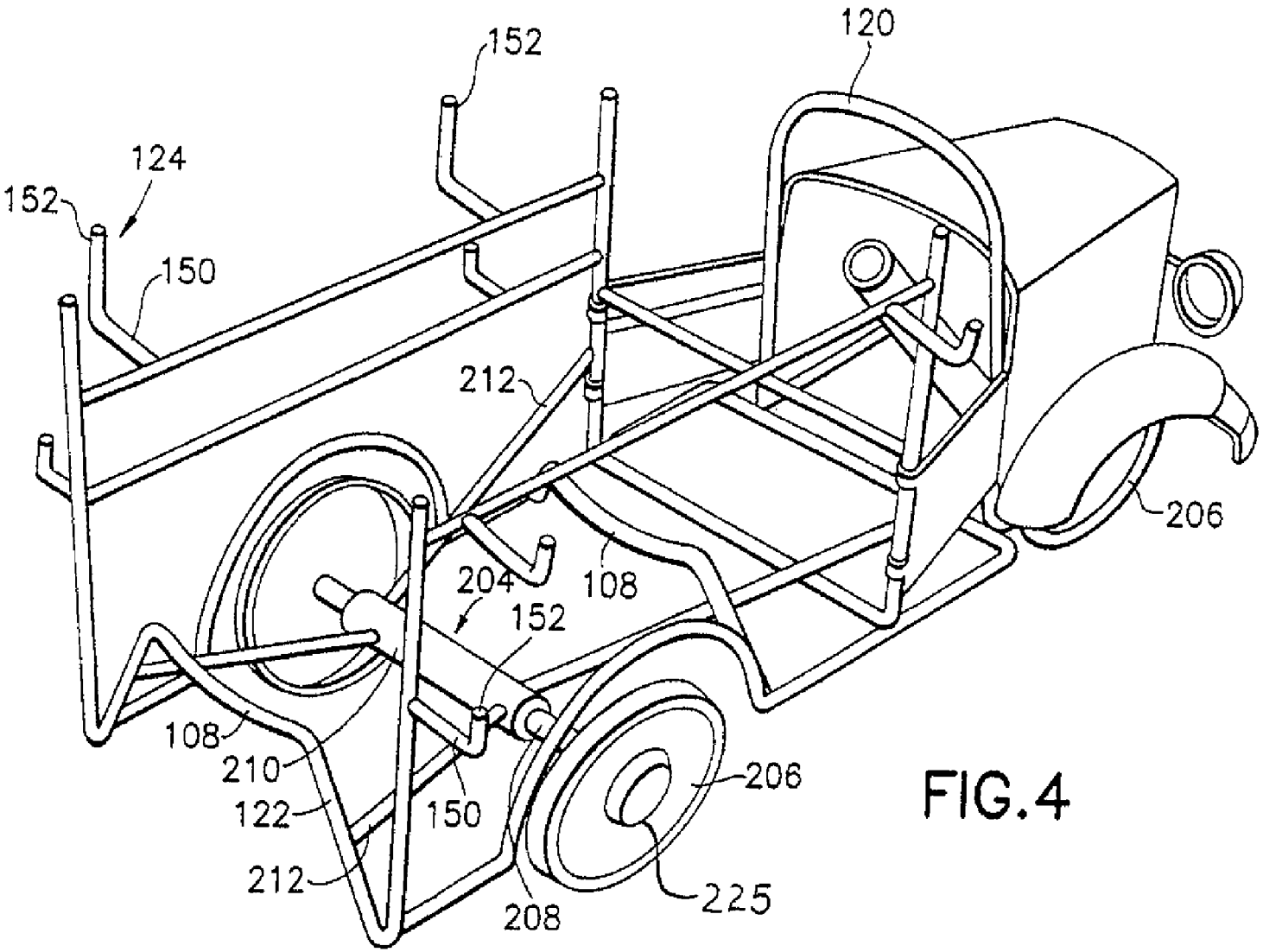
FIG. 4 depicts an alternative platform module.

The platform module 120 generally comprises a platform 122, a means 124 such as brackets 150 with hooked ends 152, supports 108 or snap or friction fit connections (not shown) for detachably securing the bar tools to specific locations on the platform 122. The platform module 120 may also include means 206 (as shown in FIG. 4) adapted for movably transporting the platform module 120 or the bar tool assembly 100 across a substantially flat surface (e.g., bar tabletop, counter, and the like). In the embodiment depicted in FIG. 4 the means 204 adapted for movably transporting the platform module include wheels.

The means 204 as shown in FIG. 4 generally comprise wheels 206 but may also comprise caterpillars, rollers, among other means suitable for transporting the platform module 120 or the bar tool set 110 across, for example, flat, near-flat, or curved surfaces of counters or bar tabletops. When wheels 206 are used, their rotation with respect to the platform module 120 may be performed by an axle 208 positioned and rotatable within a collar support 210 connected to the platform module by one or more beams 212.

In one exemplary embodiment, the consumer product is a toy replica of a fire truck. However, in alternate embodiments, the bar tool assembly 100 may have form factors and appearances of other recognizable products or replicas thereof (e.g., aircrafts, rockets, ships or boats, communication devices, various vehicles including railroad vehicles, cement trucks, dump trucks, household articles, and the like).

Individual components of the bar tool assembly 100 may be formed from plastics, metals, composites, and like materials or combination thereof. At least external (i.e., viewable) surfaces of the components may by painted, coated, or otherwise treated to resemble the respective portions and characteristic details and/or markings of the fire truck (e.g., license plates, operator's name/emblem, warning signs, etc.).

Figure 3:
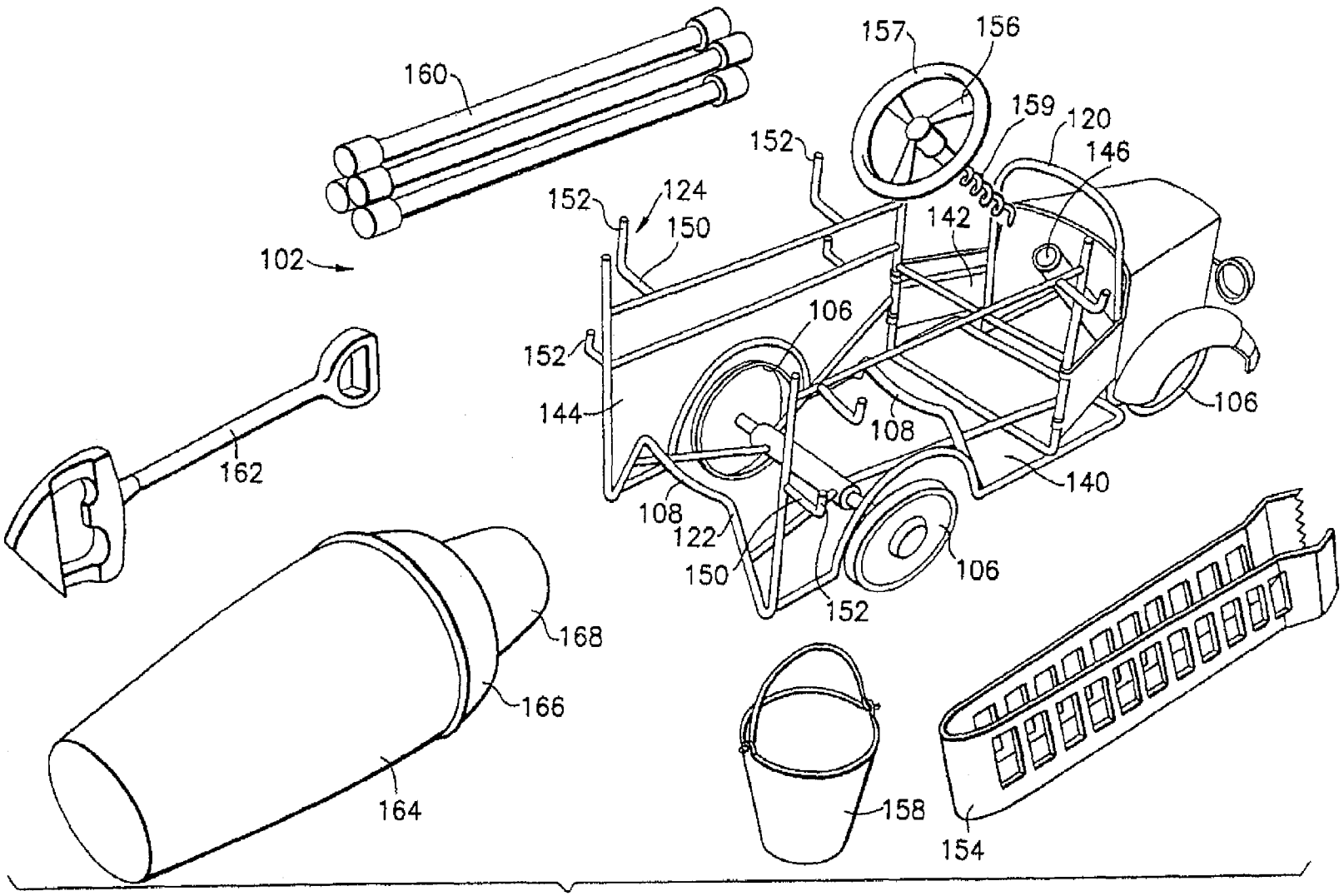
FIG. 3 depicts the various components of the bar tool assembly, including a platform module.

Referring to FIGS. 1-3, the platform module 120 generally includes a chassis 140 having a front section resembling a driver's cabin 142 and a rear section 144 defining a space framework. A set of wheels 106 are attached to the chassis 140 as shown. In one embodiment, the driver's cabin 142 and rear section 144 are permanently affixed to each other (e.g., welded to or molded together with the chassis 110). The wheels 106 may be permanently fixed to the chassis or rotatably mounted thereto, such as wheels 206 shown in FIG. 4.

In one alternate embodiment, the wheels 206 or, alternatively, the chassis 102 are provided with a means 225 for reversibly mobilizing/immobilizing rotational motion of the wheels 206. In operation, such means allow a person operating the bar tool assembly 100 to facilitate stationary positioning of the assembly at a pre-selected location on, for example, a bar tabletop or a counter.

The space framework 144 comprises the brackets 150 having the hooked ends 152 adapted for housing and transporting the respective bar tools 102 of the bar tool set 110. The brackets 150 may be affixed to the space framework 144 either permanently (e.g., be formed as integral portions of the framework 144 as shown in the figures) or detachable (not shown). If detachable, the amount and location of the brackets 150 on respective elements of the space framework 144 may be selectively adjusted for supporting bar tools having different form factors or dimensions, or for supporting more bar tools or different bar tools.

Referring to FIG. 3, the bar tool set 110 illustratively includes the ice tongs 154, a corkscrew 156, a jigger 158, at least one stirrer 160 (four stirrers are shown in FIG. 3), a bottle opener 162 and a shaker 164 having a removable lid 166 and a removable straining cap 168.

In one embodiment, the ice tongs 154, the jigger 158, the stirrers 160, and the bottle opener 162 are detachably mounted on the respective brackets 150 and/or on the hooked ends 152 of the space framework 144, the corkscrew 156 is detachably mounted in the driver's cabin 142, and the shaker 164 is removably mounted on the rear section 144 of the chassis 140. In alternate embodiments (not shown), the bar tool set 110 may comprise either more or less bar tools or other bar tools, as well as have at least one bar tool mounted on the platform module 120 in a manner different from the depicted exemplary embodiment of FIGS. 1-4.

Each bar tool of the bar tool set 110 has a form factor and appearance of a respective portion of the toy fire truck. Referring to FIG. 3, the ice tongs 154, the jigger 158, the stirrers 160, bottle opener 162, and the shaker 164 resemble a ladder, a bucket, a fire hose, a shovel, and a water tank, respectively. An upper portion 157 of the corkscrew 156 has a form factor and appearance of a steering wheel of the toy fire truck, whereas a lower portion 159 of the corkscrew, can be disposed and concealed in a receptacle resembling a steering column 146 in the driver's cabin 142. In alternate embodiments, at least a portion the same and/or other bar tools may be formed to resemble other components of the toy fire truck.

In operation, a servicing person (e.g., bartender) removes from the platform module 120 one or more bar tools 102 of the bar tool set 110 as needed to prepare a mixed drink or cocktail. After the beverage has been prepared, the servicing person places the bar tools (after cleaning, if necessary) back onto the respective brackets 150 of the platform module 120. The bartender may transport the bar tool assembly 100 to a position proximate to the customer, e.g., move the assembly 100 across a bar tabletop or a counter, and prepare the ordered beverage at that location. Similarly, in a commercial establishment several bartenders may share the bar tools of the bar tool set 110 by transporting the bar tool assembly 100 between themselves, i.e. by rolling the chassis 140 across the bar table top.

As should be readily apparent from the figures, the shaker 164 comprises a portion of the overall "body" of the assembly 100, i.e. a portion of the fire truck and, in particular, the "water tank" rear portion of the body. Thus, when the shaker 164 is in its intended position on the supports 108 of the space framework 144, the consumer product, namely, the toy fire truck replica, has a complete appearance, and when the shaker 164 is removed from the space framework 144, the toy fire truck has an incomplete appearance. As a result of the separable components of the assembly 100, with one or more of the components comprising a portion of the overall assembly and all or most of the components designed with a common theme that is related or otherwise associated with the design or theme of the platform module 120, a bar tool assembly is provided having a unique entertainment and novelty value.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A bar tool set assembly for producing mixed beverages, comprising:

a platform module adapted for housing a bar tool set on a substantially flat surface, the platform module having a form factor and appearance of a partially disassembled replica of a toy truck; and the bar tool set detachably disposed on the platform module, said bar tool set comprising a shaker adapted for detachable receiving in a pre-determined position on the platform module, wherein the platform module comprises a chassis and a driver's cabin, the chassis having a chassis portion adapted for providing the detachable receiving of the shaker, such that when the shaker is received in the pre-determined position, the replica of the toy truck is substantially presented.

2. The assembly of claim 1, wherein said assembly attains a form factor and appearance of the replica of the toy truck when the shaker is disposed on the chassis portion of the platform module.

3. The assembly of claim 1, wherein said replica of the toy truck is a replica of a toy fire truck.

4. The assembly of claim 3, wherein the platform module further comprises wheels coupled to the chassis, and a space framework affixed to the chassis and comprising a plurality of brackets.

5. The assembly of claim 4, wherein the wheels are rotatably coupled to the chassis.

6. The assembly of claim 4, wherein the bar tool set further comprises:

a corkscrew having a form factor and appearance of a steering wheel coupled to a steering column;

a bottle opener having a form factor and appearance of a shovel;

a jigger having a form factor and appearance of a bucket; and ice tongs having a form factor and appearance of a ladder.

7. The assembly of claim 6, wherein the shaker is adapted for mounting, directly or indirectly, on the chassis portion of the platform module.

8. The assembly of claim 6, wherein the corkscrew is adapted for mounting in the driver's cabin.

9. The assembly of claim 6, wherein the bottle opener, the jigger, and the ice tong are adapted for selectively mounting on the brackets of the space framework.

10. A bar tool set for producing beverages, comprising:

a shaker; and a platform module adapted for housing at least a portion of the shaker, the platform module having a form factor and appearance of a partially disassembled replica of a toy fire truck, wherein the shaker is adapted for detachable receiving in a pre-determined position on the platform module and has a form factor and appearance of one or more portions of said replica of the toy fire truck such that when the shaker is received in the pre-determined position, the replica of the toy fire truck is substantially presented, wherein the platform module comprises a chassis, a driver's cabin, wheels and a space framework affixed to the chassis and comprising a plurality of brackets adapted for detachably housing the shaker.

11. The bar tool set of claim 10, wherein the bar tool set comprises:

the shaker having a form factor and appearance of a water tank;

a corkscrew having a form factor and appearance of a steering wheel coupled to a steering column;

a bottle opener having a form factor and appearance of a shovel;

a jigger having a form factor and appearance of a bucket; and ice tongs having a form factor and appearance of a ladder.

12. The bar tool set of claim 11, wherein the corkscrew is adapted for mounting in the driver's cabin.

13. The bar tool set of claim 11, wherein the bottle opener, the jigger, the at least one stirrer, and the ice tong are adapted for selectively mounting on the brackets of the space framework.

* * * * *